United States Patent [19]

Laurie

[11] Patent Number: 4,883,296

[45] Date of Patent: Nov. 28, 1989

[54] HANDLE ASSEMBLY

[75] Inventor: Stephen A. Laurie, Crewe, England

[73] Assignee: Rolls-Royce Motor Cars Limited, Crewe, England

[21] Appl. No.: 148,019

[22] Filed: Jan. 25, 1988

[30] Foreign Application Priority Data

Jan. 28, 1987 [GB] United Kingdom ..... 8701875

[51] Int. Cl.[4] ..... E05C 21/00

[52] U.S. Cl. ..... 292/336.3; 292/DIG. 37; 292/DIG. 53; 292/DIG. 64

[58] Field of Search ..... 292/216, 336.3, 347, 292/DIG. 37, DIG. 53, DIG. 64, DIG. 60

[56] References Cited

U.S. PATENT DOCUMENTS 2,739,831 3/1956 Jakeway ..... 292/DIG. 37 X
3,162,374 12/1964 Skokut ..... 292/DIG. 37 X

FOREIGN PATENT DOCUMENTS 215907 10/1957 Australia ..... 292/DIG. 37
1607397 3/1950 Fed. Rep. of Germany .
2475100 1/1981 France .
912111 12/1962 United Kingdom .

*Primary Examiner*—Richard E. Moore
*Attorney, Agent, or Firm*—Cushman, Darby & Cushman

[57] ABSTRACT

A vehicle door handle assembly comprises a handle pivotally connected to a base plate. The handle assembly is connected to a door sub-assembly by screws. The handle comprises a button which when depressed enables a restraint to be drawn into an operative position by a screw extending through the shut face of the door. When released, the button is locked in position by the restraint and prevents access to the screw. This screw, when removed permits the handle and plate to be pivoted away from one another to reveal another screw which may then be removed to remove the handle assembly from the door. The handle assembly can therefore be removed from the door from externally of the door but only when the door is open thus facilitating painting and maintenance.

10 Claims, 4 Drawing Sheets

12A
2
1
18
19
7
10
X
5
6
10A
9
12B
30
4
17
12C
2

5
12B
9
22
7
6
6A
1A
1
37
36
10
10A
36
4
10B
12A
32
31
2
17
33
35
29
28
13
34
3
26
25

HANDLE ASSEMBLY

The present invention relates to a handle assembly particularly, but not exclusively, for a vehicle door.

In the assembly of vehicles, and in particular in the assembly of automobiles the provision of door handles on the car body prior to the painting process means that the handle needs to be protected from the paint during painting. Alternatively, the assembly of door handles after painting may result in damage to the paintwork. Furthermore, after manufacture removal of the handle is usually impossible without dismantling the door which is a lengthy and therefore an expensive procedure.

An object of the present invention is to alleviate these problems.

According to the present invention, there is provided a handle assembly for a closure member comprising a handle having a portion which may be resiliently moved in relation to the remainder of the handle between a first inoperative position and a second operative position in which a closure member to which the handle is attached may be opened, and means for connecting the handle assembly to the closure member, from externally of the closure member access to said means being prevented by the handle when the handle is so connected, said means for connecting comprising a restraint preventing removal of the portion and said restraint being accessible only when the closure member is in an open position.

In a preferred embodiment of the invention, the handle is connected to the door by connecting members such as screws which screw into a substantially plate form member connected to the interior face of the closure member. The portion of the handle is a button which fits into an aperture defined by the remainder of the handle. This button is spring loaded. A rod extends from the underside of the button which is formed for engagement with a trap plate which constitutes the restraint. This trap plate sits underneath the button and is drawn into the operative position when the button is depressed against its spring by a screw extending through the shut face of the closure member (door). When the button is released it is retained in the remainder of the handle by the trap plate. By loosening this screw, which is only accessible when the door is open, the button can be released thus allowing access to the screws connecting the handle to the door. The handle may then be removed from externally of the door thus greatly facilitating maintenance.

Figure 1:
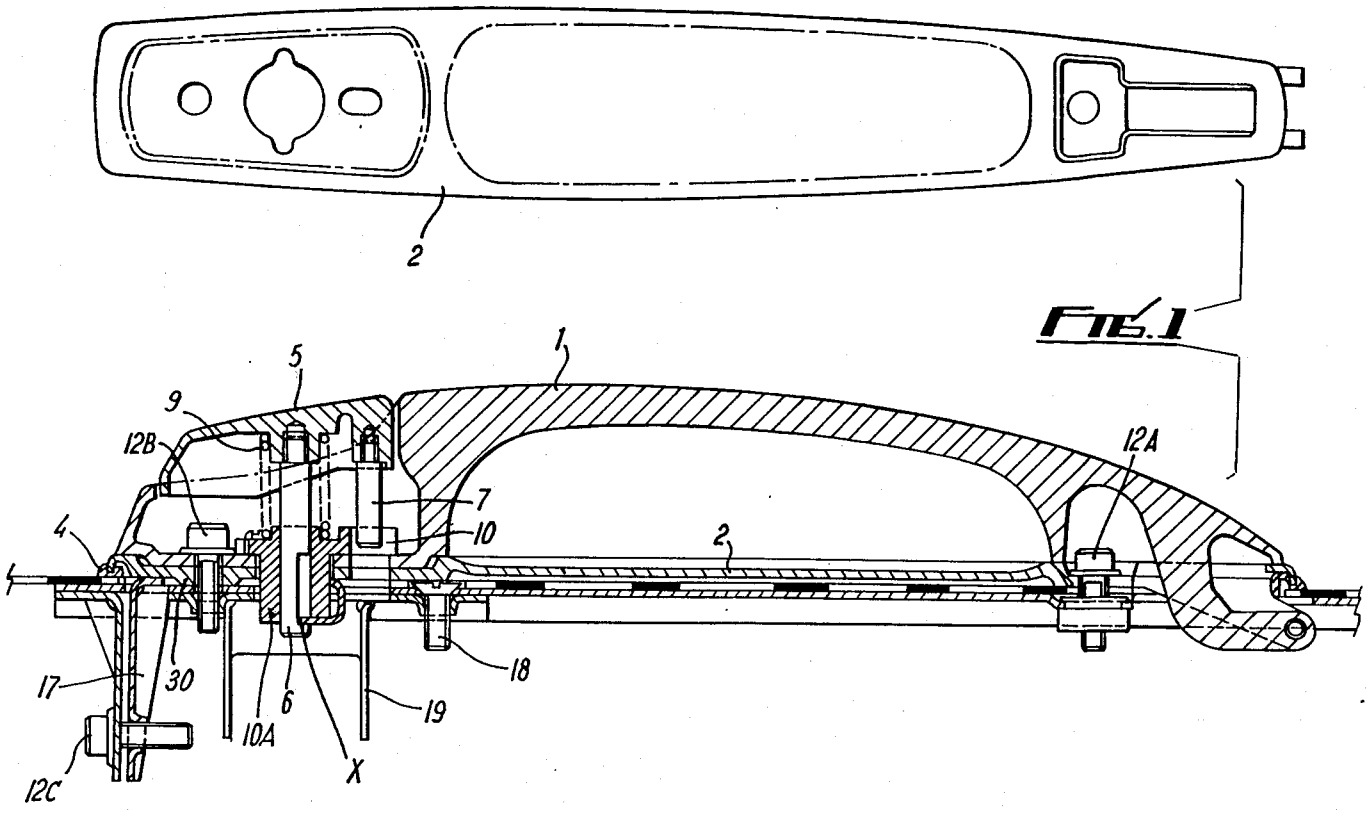
Figure 2:
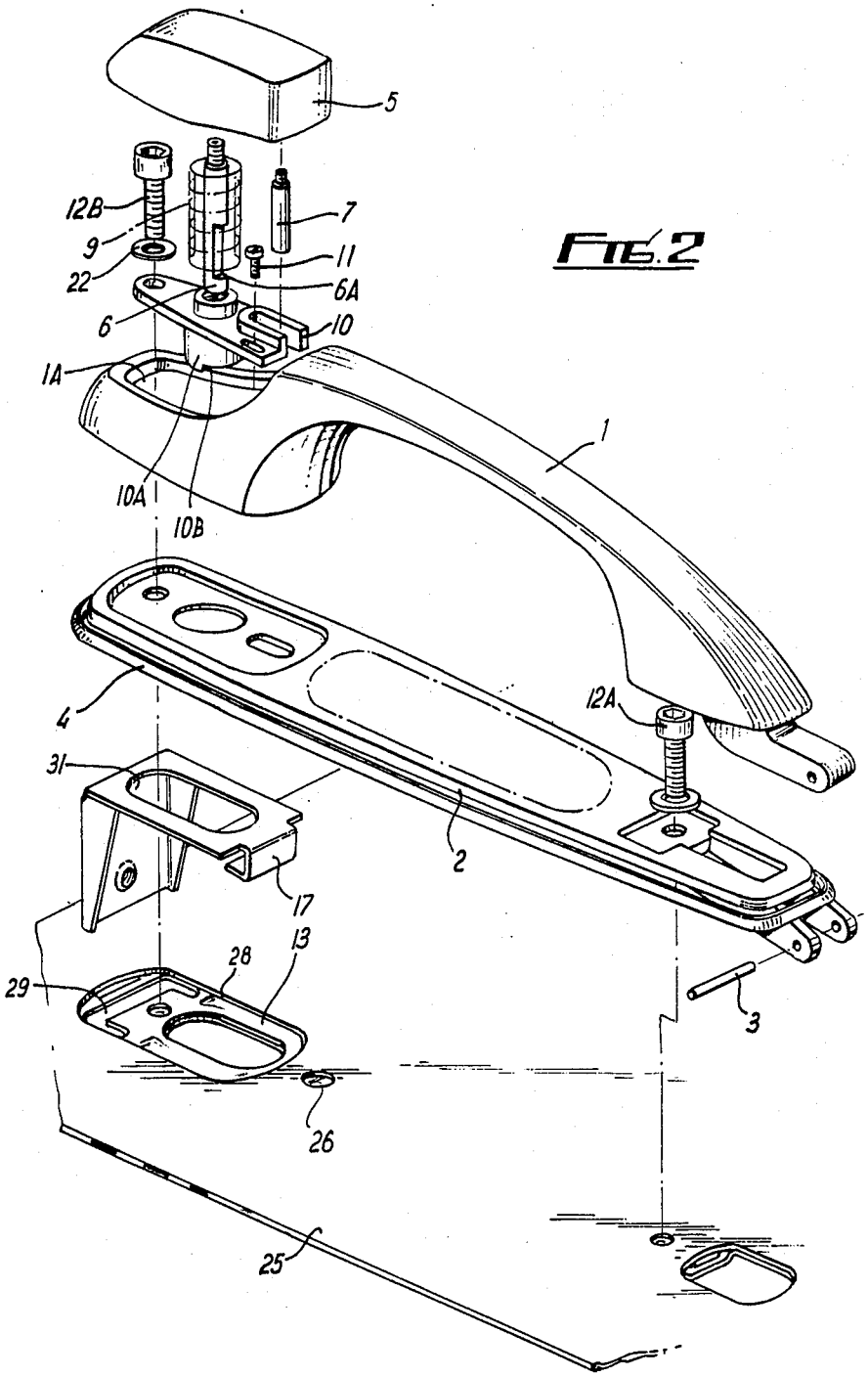
Figure 3:
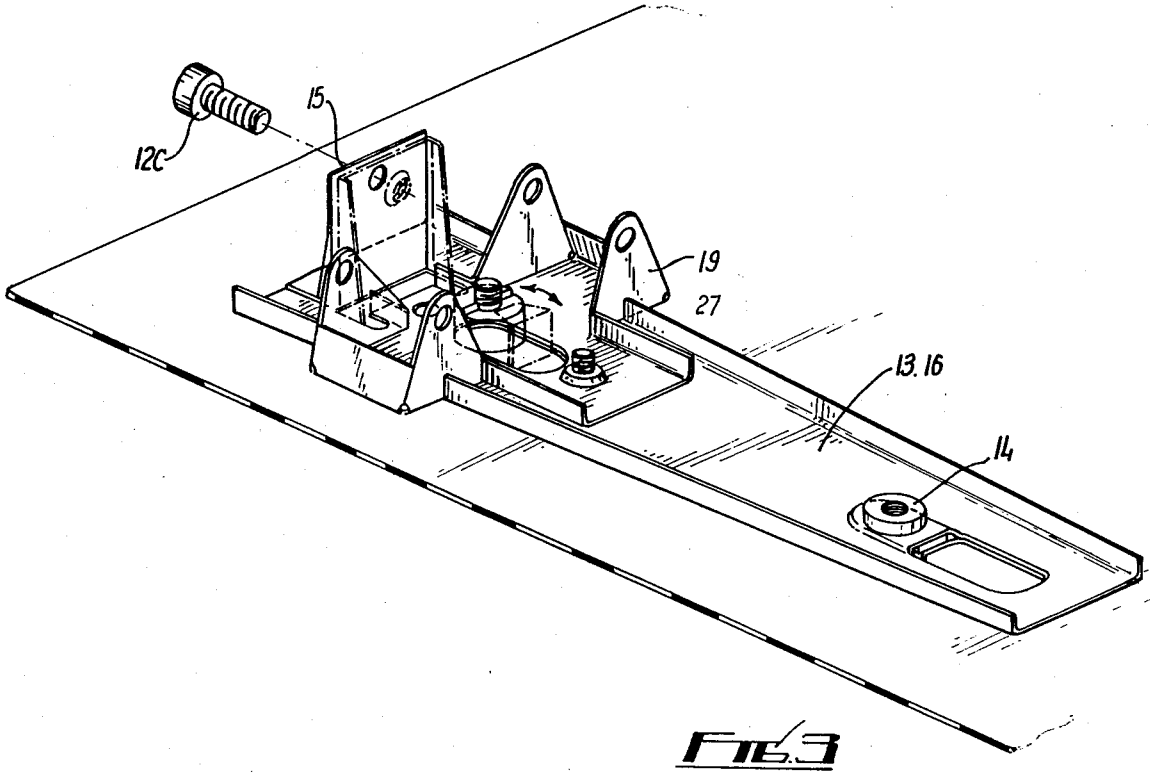
Figure 4:
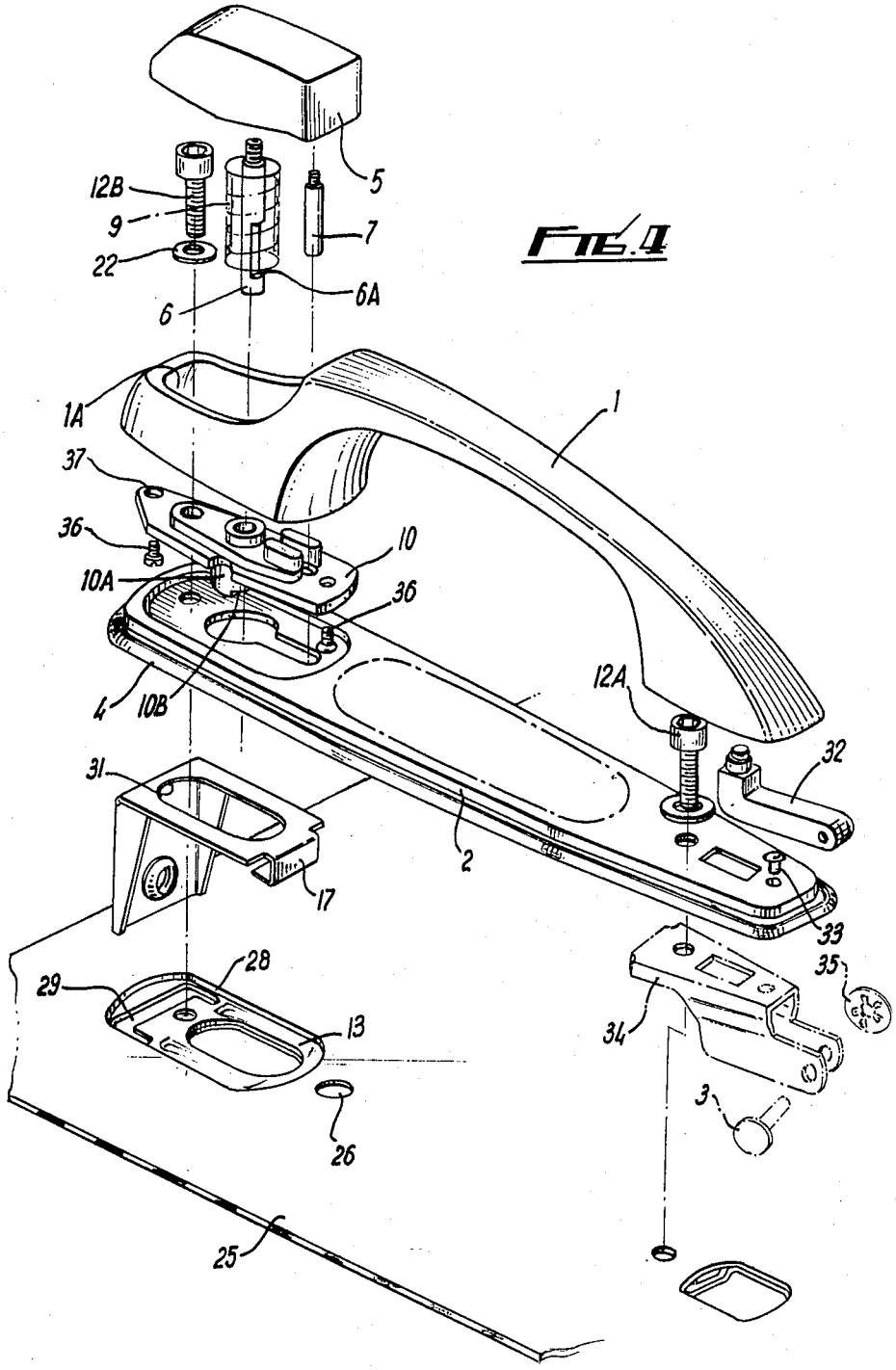

In order that the invention may be more clearly understood, two embodiment thereof will now be described, by way of example, with reference to the accompanying drawings in which:

FIG. 1 shows a side elevation in section of a handle assembly for an automobile, FIG. 2 shows an exploded view externally of the door of the handle assembly of FIG. 1, FIG. 3 shows an exploded view from internally of the door of the handle assembly of FIGS. 1 and 2, and FIG. 4 shows a view, corresponding to FIG. 2,of a modified form of the embodiment of FIGS. 1 to 3.

Referring to the drawings, the handle assembly comprises a handle 1 defining an aperture 1A at one end in which a push button 5 is disposed. The handle 1 is connected to a base plate 2 which is connected to the door panel 25 on which the handle is to be mounted. A gasket 4 is fitted around the base plate 2 to protect the paint on the panel 25.

A sub-assembly comprising a reinforcing plate 13, a clinch nut 14, a pivot mounting bracket 19 and a clamp bracket 15 is provided on the underside of the door panel to the interior of the automobile. This sub-assembly is shaped to receive through an aperture in the door panel 25 a trap plate 17 of substantially inverted 'L' shaped cross section.

The reinforcing plate 13, clinch nut 14 and clamp bracket 15 are connected to the underside of the door panel in a pre-assembly operation. To assemble the handle, the pivot mounting bracket 19 is connected to the plate 13 by a screw 18 extending from the exterior of the door panel through an aperture 26 in the panel 25 into a screw threaded boss 27 on the bracket 19.

The trap plate 17 is then fitted through a slot 28 in the skin of the door panel and through slot 29 in the plate 13. Plate 17 rests on plate 13 and is allowed to slide when trapped between the plate and the base plate 2 due to a boss 30 formed on the underside of the plate 2 which extends through an aperture 31 formed in the plate 17. The handle pivots at the front about a pin 3, which is attached to the base plate 2, the geometry of this hinge enables the handle to pivot clear of the base plate 2 and the door skin to allow access to a first mounting screw 12A. The handle is then allowed to join the base at the rear and a second mounting screw 12B is then applied.

Disposed in the aperture 1A of the handle 1 is an adjustable guide bush 10 fitted prior to the handle being placed on the door using screw 11. This guide bush 10 is fixed to the plate 13 by means of the screw 12B already described. The bush 10 incorporates an apertured boss 10A which provides a stop face 10B. A guide rod 6 which is screwed into a complementary screwthreaded aperture in the underside of the button extends through the boss. A helical spring 9 is constrained to act between this boss and the underside of the button 5. A guide pin 7 is provided to keep the button 5 central in its aperture 1A.

To complete the assembly procedure the button 5 is fully depressed into the aperture 1A. This pushes the guide rod 6 down beyond the boss 10A revealing a notch 6A in the rod. This permits the trap plate 17 to be drawn against the stop face 10B by means of a screw 12C screwed into the plate 17 from the shut face of the door. This in turn retains the rod 6 in the handle when the button 5 is released and returns under the action of the spring 9 due to the abuttment between the trap plate 17 and the rod 6 at the point marked X on FIG. 1.

Disassembly is the reverse of assembly. Security is provided because disassembly must begin by first loosening the screw 12C and access to this screw can only be gained when the door is open. Loosening the screw 12C enables the button 5 to pop out under the action of the spring 9 permitting access to screws 12A and 12B.

FIG. 4 shows a modification of the handle assembly shown in FIGS. 1 to 3. In this drawing, parts the same as, or equivalent to, parts of the embodiment of FIGS. 1 to 3 bear the same reference numerals. As compared with the assembly of FIGS. 1 to 3, the shape of the adjustable guide bush 10 is altered as shown and is disposed beneath the handle 1 in which position it is screwed directly to the handle 1 by means of two screws 36 which extend through corresponding apertures 37 in bush 10 into threaded blind bores in the handle 1. Thus screw 11 is dispensed with.

The handle 1 pivots as before about its front end. However, the cooperating parts of the hinge are separate components connected respectively to the handle 1 and base 2. Thus foot 32, is silver soldered to handle 1 and bracket 34 is connected initially by a solid rivet 33 to base 2 until assembly when screw 12A also performs to function. The pin 3 which extends through the hinge parts 32 and 34 is provided with a head at one end and a lock washer 35 at the other.

This arrangement enables the handle 1 and base 2 to be forged from brass, the handle 1 by a hot stamping and base 2 by cold. Those intricate parts such as the foot 32 which are difficult if not impossible to forge are made as separate parts. Aperture 1A cannot be formed as before and bearing 10 is therefore attached directly to the underside of the handle 1 as described. Forging in turn enables a higher quality finish to be achieved than would be possible with the die cast parts of the first embodiment.

It will be appreciated that the above embodiments have been described by way of example only and that many variations are possible without departing from the scope of the invention.

I claim:

1. A handle assembly for a closure member comprising a handle having a portion mounted to be resiliently moved in relation to the remainder of the handle between a first inoperative position and a second operative position in which a closure member to which the handle is attached may be opened, and means for connecting the handle assembly to the closure member, from externally of the closure member, access to said means being prevented by the handle when the handle is so connected, said means for connecting including a restrain preventing removal of the portion of said restraint being accessible only when the closure member is in an open position; release of said restraint permitting access for further manipulating of said means for connecting.

2. A handle assembly as claimed in claim 1, in which the handle is connected to the door by connecting members which extend into a substantially plate form member adapted to be connected to the interior face of the closure member.

3. A handle assembly as claimed in claim 1 in which the portion of the handle is a button which fits into an aperturedefined by the remainder of the handle.

4. A handle assembly as claimed in claim 3, in which the button is spring loaded.

5. A handle assembly as claimed in claim 1 in which a rod extends from the underside of the portion which is formed for engagement with the restraint.

6. A handle assembly as claimed in claim 1 in which the restraint is disposed beneath the portion and may be drawn into its operative position by a member adapted to extend through the shut face of the closure member when the portion is moved into its second operative position such that when the portion is released to return to its first inoperative position it is retained in the remainder of the handle assembly.

7. A handle assembly as claimed in claim 1, in which a sub assembly is provided adapted to be connected to the interior surface of the closure member to which the restraint may be connected to connect the handle assembly to the closure member.

8. A handle assembly as claimed in claim 5, in which an adjustable guide bush which defines an apertured boss having a stop face is connected to the handle, the rod extends through the boss, and resilient means are constrained to act between the boss and the underside of the portion, the arrangement being such that when the portion is moved to its second, operative, position, a notch in the rod is revealed which enables the restraint to be drawn against the stop face to retain the rod in the handle assembly when the portion is released to return to its first operative position.

9. A handle assembly as claimed in claim 1 in which the handle assembly comprises a handle and a base plate which are pivotally connected together, relative pivotal movement being permitted after removal of the portion to enable the assembly to be removed from the closure member.

10. A handle assembly as claimed in claim 9 in which the base plate is adapted to be connected to the closure member by means of connecting members one of which is accessible after removal of the portion and the other being accessible after relative pivotal movement of the handle and plate.

* * * * *